United States Patent [19]

Suzuki et al.

[11] Patent Number: 4,881,917

[45] Date of Patent: Nov. 21, 1989

[54] REMOTE CONTROL STEERING MECHANISM

[75] Inventors: Katsumi Suzuki, Tokyo, Japan; Woo S. Yang, Seoul, Rep. of Korea

[73] Assignee: ITLA Corporation, Burbank, Calif.

[21] Appl. No.: 139,594

[22] Filed: Dec. 30, 1987

[51] Int. Cl.[4] ..... A63H 17/36; A63H 30/04; A63H 29/22; A63H 33/26

[52] U.S. Cl. ..... 446/468; 446/456; 446/484; 446/129

[58] Field of Search ..... 446/468, 465, 456, 454, 446/457, 460, 431, 437, 133, 130, 129, 484, 485, 139, 136, 135, 134

[56] References Cited

U.S. PATENT DOCUMENTS

| | | | |
|---|---|---|---|
| 2,903,821 | 9/1959 | Favre | 446/130 |
| 3,596,401 | 8/1971 | Camire | 446/130 |
| 3,733,744 | 5/1973 | Hiltpold et al. | 446/462 |
| 4,471,566 | 9/1984 | Ishimoto | 446/460 X |
| 4,743,214 | 5/1988 | Tai-Cheng | 446/129 |

FOREIGN PATENT DOCUMENTS

| | | | |
|---|---|---|---|
| 0280496 | 8/1988 | European Pat. Off. | 446/129 |
| 588335 | 11/1933 | Fed. Rep. of Germany | 446/454 |
| 1048527 | 1/1959 | Fed. Rep. of Germany | 446/129 |
| 2229772 | 6/1972 | Fed. Rep. of Germany | 446/454 |
| 426286 | 9/1948 | Italy | 446/454 |
| 252553 | 1/1948 | Switzerland | 446/454 |
| 1581242 | 12/1980 | United Kingdom | 446/456 |
| 2112655 | 7/1983 | United Kingdom | 446/456 |

*Primary Examiner*—Robert A. Hafer
*Assistant Examiner*—D. Neal Muir
*Attorney, Agent, or Firm*—Staas & Halsey

[57] ABSTRACT

A steering mechanism for a radio controlled device that employs a solenoid coil and is insensitive to frequency flucuations in a control signal. The steering mechanism includes opposing poles of a permanent magnet and a solenoid coil positioned equidistant between the poles so as to be pivotable to positions opposing each of the individual poles.

9 Claims, 2 Drawing Sheets

REMOTE CONTROL STEERING MECHANISM

BACKGROUND OF THE INVENTION

The present invention relates to remote control toy devices, and in particular, a novel steering mechanism for a radio controlled device.

Previously, steering of a radio controlled device was controlled in response to fluctuations in the frequency of a signal received by the device. The frequency fluctuations caused a servomotor to change directions; thus, changing the direction in which a device was steered. However, noise such as RF noise omitted from the motor in the device or other noise tends to cause inadvertent fluctuations in the frequency of the signal received by the device. As a result, steering was subject to inadvertent and unwanted changes. A control circuit that avoids such misoperations is expensive; thus, raising the cost of the device.

SUMMARY OF THE INVENTION

An object of the present invention is to provide a simple steering mechanism for a radio controlled device.

Another object of the present invention is to provide a steering mechanism for a radio controlled device that is insensitive to frequency fluctuations in the control signal.

A further object of the present invention is to provide a steering mechanism for a radio controlled device that employes a solenoid coil.

To achieve the and other objects, the present invention comprises: a frame having a pivot point, a permanent magnet assembly having spaced apart opposing poles being mounted on the frame, a coil, a holding means that is pivotable about the pivot point, and which holds the coil adjacent to the permanent magnets, energizing means that is operatively connected to the coil and which provides a current to the coils so as to pivot the holding means about the pivot point, and biasing means that positions the coil substantially equidistant from at least two of the opposing poles.

In a preferred embodiment of the present invention, the frame can take any shape, for example, the shape of a toy sports car. The permanent magnet assembly can comprise two magnets positioned on the frame with alternate poles facing away from the frame. The holding means can include an elongated member clamping the coil so that it is above and parellel to the permanent magnets and mounted on a pin so that the coil can rotate. The biasing means can comprise two spring loaded levers, each applying an equal and opposite force on the holding means so as to position the coil midway between the two permanent magnets.

The above and other objects of the present invention will be apparent from the following in conjunction with the figures in which like reference numerals identify like or similar elements.

DETAILED DESCRIPTION OF THE PREFERRED EMBODIMENTS

Figure 1:
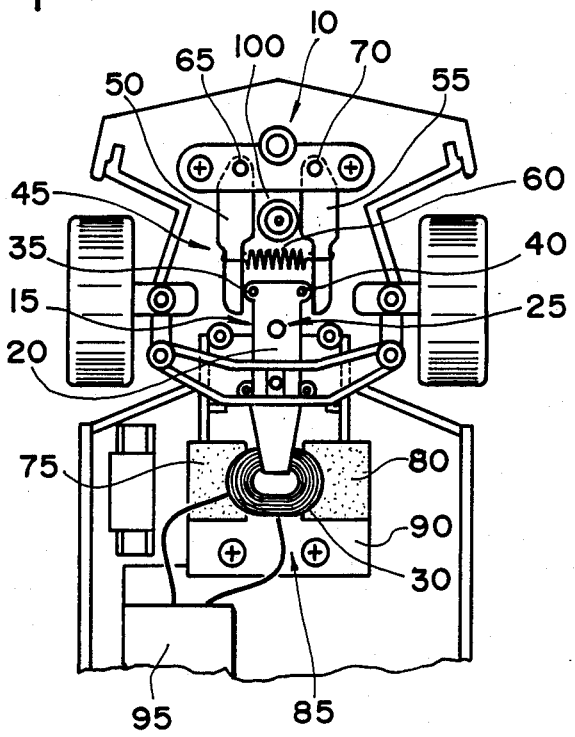
FIG. 1 illustrates an embodiment of the present invention in a neutral state.

FIG. 1 illustrates a first embodiment of the present invention as embodied in the steering mechanism of a toy car. FIG. 1 is a view of the underside of the toy car. Reference numeral 10 identifies a frame of the toy car. Reference numeral 15 identifies a holding means which includes a guide member 20 pivotably mounted on a pivot point 25, and a coil 30 attached to one end of the guide member 20. The coil 30 is held by the guide member 20 so that the coil 30 is in a plane perpendicular to the pivot point 25. Positioned at the opposite end of the guide member 20 are a first guide pin 35 and a second pin 40. These guide pins contact a biasing means 45. The biasing means includes a first steering lever 50, a second steering lever 55 and a spring member 60. The first steering lever 50 has a first end rotatably mounted on a first support pin 65, and a second end contacting the first guide pin 35. The second steering lever 55 has a first end rotatably mounted on a second support pin 70, and a second end contacting the second guide pin 40.

As illustrated in FIG. 1, the spring member 60 is a simple coil spring connected between the first steering lever 50 and the second steering lever 55. The spring member 60 forces the first steering lever 50 and second steering lever 50 respectively against the first guide pin 35 and the second guide pin 40 so as to hold the coil 30 in a position that is substantially equidistant from a first pole 75 and a second pole 80 of a permanent magnet assembly 85. The plurality of the first pole 75 is opposite the plurality of the second pole 80. As shown in FIG. 1, the permanent magnet assembly 85 has the first pole 75 and second pole 80 positioned in a plane substantially parellel to the plane containing the coil 30. The first and second poles (75, 80) can be mounted on the frame 10 or any suitable plate such as the plate 90.

An energizing means 95 provides a current to the coil 30. By changing the direction of the current through the coil 30, the coil 30 is attracted to one of the first or second poles (75, 80) and simulaneously repelled from the other one of the first and second poles (75, 80).

Figure 2:
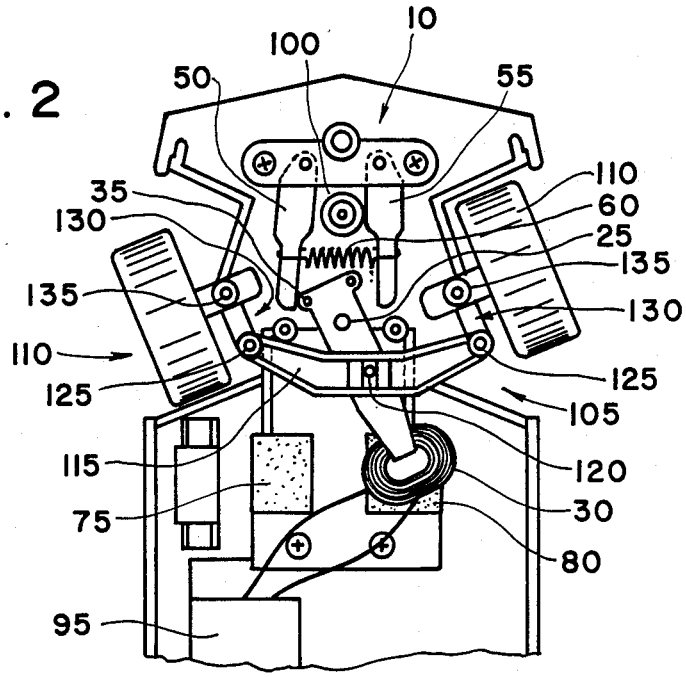
FIG. 2 illustrates the embodiment of FIG. 1 in an active state.

FIG. 2 illustrates the steering mechanism for a radio control device in an active state. As illustrated, the energizing means 95 is providing a current to the coil 30 so that it is attracted to the second pole 80 and repelled from the first pole 75. In this state, the first guide pin 35 is driven against the first steering lever 50, stretching the spring member 60. A pin 100 holds the second steering lever 55 in place. Thus, when the energizing means 95 stops providing a current to coil 30, the spring member 60 forces the first steering lever 50 against the first guide pin 35 so as to rotate the guide member 20 and coil 30 to the neutral position as shown in FIG. 1.

Thus, by the energizing means 95 supplying current to the coil 30 in either of two directions, the guide member 20 is pivoted about the pivot point 25, causing a steering linkage 105 to change the direction of wheels 110. The steering linkage 105 includes a steering assembly 115 rotatably mounted on a pin 120 which is in turn attached to the guide member 20. With this arrangement, rotation of the guide member 20 causes the steering plate 115 to move in either the right direction or the left direction.

As shown in FIG. 2, the steering assembly 115 is connected to a pin 125. The pin 125 protrudes from a support assembly 130 which is rotatably mounted on the frame 10 and which rotatably houses an axle connected to the wheel 110. In operation, rotation of the guide member 20 in a counterclockwise direction, as shown in FIG. 2, causes the steering assembly 115 to pull on the pin 125 causing the support assembly 130 to rotate in the counterclockwise direction about a pin 135.

Figure 3A:
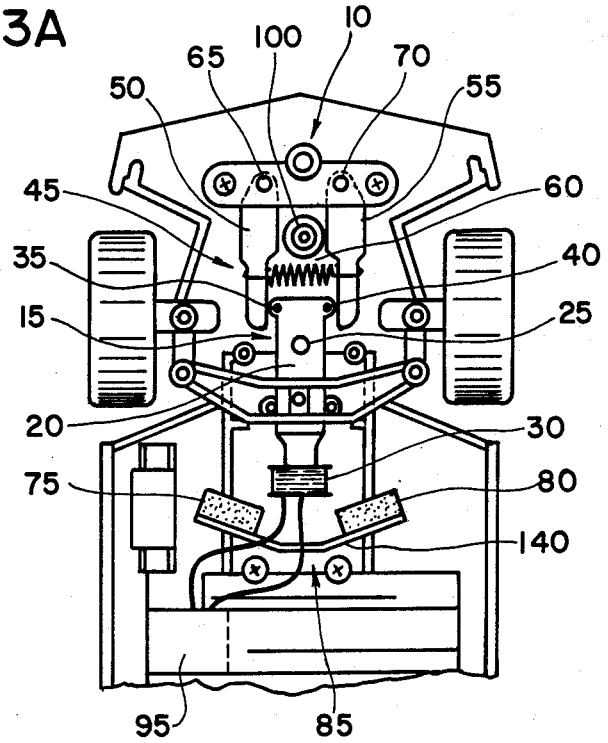
FIG. 3A illustrates a second embodiment of the present invention in a neutral state.

FIG. 3A illustrates a second embodiment of the present invention. In FIG. 3A, coil 30 is positioned in a neutral position equidistant from the first pole 75 and the second pole 80. Unlike the embodiment illustrated in FIG. 1, the coil 30 is mounted in a plane substantially perpendicular to the frame 10. Similarly, the first and second poles (75,80) are mounted in planes substantially perpendicular to the frame 10. FIG. 3A illustrates the first and second poles (75,80) being positioned at an angle with respect to each other so that when a coil 30 faces either one of the poles, the respective planes containing the coil and the opposing pole (either 75 or 80) are substantially parellel. In is not necessary, however, to angle the first pole 75 with respect to the second pole 80 as shown in FIG. 3A.

Figure 3B:
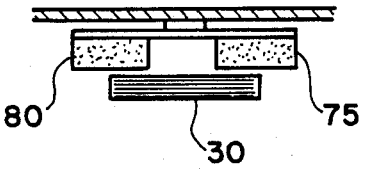
FIGS. 3B and 3C respectively illustrate third and fourth embodiments of the present invention.

FIG. 3B illustrates a third embodiment of the present invention. In FIG. 3, the coil 30 has a larger diameter than the coil shown in the FIG. 3A. In the embodiment of the FIG. 3B, the coil can be more easily moved between the first pole 75 and the second pole 80.

Figure 3C:
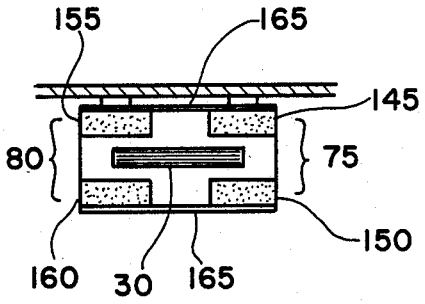

FIG. 3C illustrates a fourth embodiment of the present invention. As shown in FIG. 3C, the first coil 75 comprises two permanent magnets 145 and 150 positioned on opposing sides of coil 30. Similarly, the second pole 80 comprises two permanent magnets 155 and 160 positioned on opposing sides of the coil 30. The individual permanent magnets (145,150,155 and 160) are mounted on guide plate 165. The assembly shown in FIG. 3C can be positioned either parallel or perpendicular to the frame 10.

Those skilled in the art will recognize many variations of the steering mechanism of the present invention. The embodiments described above merely illustrate the steering mechanism of the present invention and are not intended to limit the scope of the present invention to the disclosed mechanisms. Instead, the scope of the present invention is defined by the following claims.

What is claimed is:

1. A steering mechanism for a radio control device including:

a mobile frame having a pivot point;

an annular shaped coil positioned in a first plane;

first and second spaced apart permanent magnets being positioned in a second plane and being mounted on said mobile frame, said first permanent magnet having a pole facing said coil and said second permanent magnet having a pole, opposing said pole of said first permanent magnet, facing said coil;

holding means, pivotable about said pivot point, for holding said coil adjacent to said first and second permanent magnets;

energizing means, operatively connected to said coil, for providing a current to said coil so as to pivot said holding means about said pivot point; and biasing means, for positioning said coil substantially equidistant from at least two of said opposing poles.

2. A steering mechanism for a radio control device according to claim 1, wherein in said energizing means includes means for changing the direction of said current so as to selectively position said coil over said opposing poles of said permanent magnet assembly.

3. A steering mechanism for a radio control device according to claim 1, wherein said holding means comprises a guide member having said coil attached, in a plane parallel to the first plane, to one end thereof, and having, at the opposite end thereof, a first guide pin extending from said from said guide member in a direction substantially perpendicular to the first plane.

4. A steering mechanism for a radio control device according to claim 3, wherein said biasing means includes:

a spring member; and lever means, positioned to contact said first guide pin and connected to said spring member, for applying a force to said first guide pin tending to rotate said guide member about said pivot point.

5. A steering mechanism for a radio control device according to claim 4, wherein said guide member has, at said opposite end, a second pin extending therefrom in a direction substantially perpendicular to said first plane, and wherein said lever means includes:

first and second support pins mounted on said frame;

a first steering lever, having a first end rotatably mounted on said first support pin, and a second end positioned to contact said first guide pin;

a second steering lever, having a first end rotatably mounted on said second support pin and a second end positioned to contact said second guide pin; and wherein said spring member being connected to said first and second steering levers so as to hold said first and second steering levers against said first and second guide pins, respectively.

6. A steering mechanism for a radio control device according to claim 1, wherein said first and second permanent magnets are respectively positioned in second and third planes, said second and third planes each intersecting said first plane.

7. A steering mechanism for a radio control device according to claim 3, further comprising:

third and fourth spaced apart permanent magnets positioned in a second plane parallel to the first plane and on a side of said coil opposite said first and second permanent magnets, said third permanent magnet having a pole facing said coil being the same as said one pole of said first permanent magnet, and said fourth permanent magnet having a pole facing said coil being the same of said one pole of said second permanent magnet.

8. A steering mechanism for a radio control device according to claim 3, wherein said coil has a diameter larger than the space between said first and second permanent magnets.

9. A steering mechanism for a radio control device according to claim 7, wherein said coil has a diameter larger than the space between said first and second permanent magnets and a space between said third and fourth permanent magnets.

* * * * *